US005540739A

United States Patent [19]

Hannemann et al.

[11] Patent Number: 5,540,739

[45] Date of Patent: Jul. 30, 1996

[54] PROCESS FOR DYEING NATURALLY OCCURRING OR SYNTHETIC POLYAMIDE FIBRES

[75] Inventors: Klaus Hannemann, Lörrach; Franz Grüner, Schopfheim; Martin Jöllenbeck, Müllheim, all of Germany; Jörg Binz, Aesch, Switzerland

[73] Assignee: Ciba-Geigy Corporation, Tarrytown, N.Y.

[21] Appl. No.: 274,568

[22] Filed: Jul. 13, 1994

Related U.S. Application Data

[63] Continuation of Ser. No. 11,933, Feb. 1, 1993, abandoned.

[30] Foreign Application Priority Data

Feb. 6, 1992 [CH] Switzerland ..... 334/92
Oct. 2, 1992 [CH] Switzerland ..... 3088/92

[51] Int. Cl.[6] ..... D06P 1/60; D06P 3/06

[52] U.S. Cl. ..... 8/552; 8/576; 8/586; 8/591; 8/593; 8/598; 8/599; 8/602; 8/604; 8/611; 8/613; 8/606; 8/917; 8/924; 8/907; 8/903

[58] Field of Search ..... 8/680–684, 552, 8/576, 594, 597–99, 602, 586, 588, 613, 594, 604, 606, 611, 917, 918, 903–915, 924, 925, 591, 673

[56] References Cited

U.S. PATENT DOCUMENTS

| | | | |
|---|---|---|---|
| 3,069,220 | 12/1962 | Dawson | 8/907 |
| 3,472,607 | 10/1969 | Sopers | 8/907 |
| 3,561,914 | 4/1971 | Abel et al. | 8/907 |
| 4,340,387 | 7/1982 | Evans et al. | 8/580 |
| 4,424,061 | 1/1984 | Shimohira et al. | 8/493 |
| 4,444,564 | 4/1984 | Salathé et al. | 8/588 |
| 4,563,192 | 1/1986 | Salathé et al. | 8/554 |
| 4,715,863 | 12/1987 | Navratil | 8/907 |
| 4,894,065 | 1/1990 | Annen et al. | 8/638 |
| 4,935,033 | 6/1990 | Mosimann et al. | 8/543 |
| 5,097,076 | 3/1992 | Reinehr et al. | 568/607 |

FOREIGN PATENT DOCUMENTS

| | | |
|---|---|---|
| 2378893 | 8/1978 | European Pat. Off. . |
| 59383 | 9/1982 | European Pat. Off. . |
| 089004 | 9/1983 | European Pat. Off. . |
| 312493 | 4/1989 | European Pat. Off. . |
| 378048 | 7/1990 | European Pat. Off. . |
| 406168 | 1/1991 | European Pat. Off. . |
| 1402357 | 12/1965 | France . |
| 524720 | 8/1972 | Switzerland . |
| 1195892 | 6/1970 | United Kingdom . |
| 2005663 | 4/1979 | United Kingdom . |
| 1567060 | 5/1980 | United Kingdom . |
| 2140470 | 11/1984 | United Kingdom . |
| 8807602 | 10/1988 | WIPO . |

OTHER PUBLICATIONS

Chem. Abst. vol. 64 (1966) 8379.
Derwent Publications Ltd. London, GB:AN 79–49729B (and LP–A–54, 064, 193), 1979.
L. of the Society of Dyers and Colourist vol. 103, (No. 1), 1983 Bradford GB, p. 32 to 37, Riva et al.
American Dyestuff Reporter, vol. 65 (No. 11), 1976 N.Y. USA L. Han Wood.
The Merk Index, 1983, Merck & Co. Inc. Rahway N.Y. USA 10th edition.

*Primary Examiner*—Margaret Einsmann
*Attorney, Agent, or Firm*—George R. Dohmann

[57] ABSTRACT

A process for dyeing textile materials of naturally occurring and synthetic polyamide fibres, in which dyeing is carried out at the boiling point of the dyebath during a short dyeing time which is therefore gentle on the fibres, and level dyeings having good fastness properties are obtained (high temperature rapid dyeing process).

The dyeing process is carried out with dyebaths with comprise specific surfactants. A high degree of exhaustion of the dye liquors is achieved, and dyeing from static baths is thus rendered possible.

16 Claims, No Drawings

PROCESS FOR DYEING NATURALLY OCCURRING OR SYNTHETIC POLYAMIDE FIBRES

This application is a continuation of application Ser. No. 08/011,933, filed Feb. 1, 1993, now abandoned.

The present invention relates to a process for dyeing textile materials of naturally occurring and synthetic polyamide fibres, in which dyeing is carried out at the boiling point of the dyebath during a short dyeing time which is therefore gentle on the fibres, and level dyeings having good fastness properties are obtained (high temperature rapid dyeing process).

Customary dyeing processes for the textile materials mentioned have required dyeing times which are, for example, in the range from 30 to 90 minutes. It is known that wool fibres in particular can become damaged during such long dyeing times, leading to losses in the quality of the dyed material. Furthermore, the degree of exhaustion of the dye liquors is not complete.

The object of the present invention is therefore to provide a dyeing process for dyeing textile materials of naturally occuring and synthetic polyamide fibres which does not have the disadvantages of the known dyeing processes.

It has now been found that the object put forward can be achieved surprisingly well by using specific assistants in the dyebaths.

The present invention therefore relates to a process for dyeing textile materials of naturally occurring or synthetic polyamide fibres in aqueous dyebaths comprising at least one surfactant, in particular from the group of alcohol polyalkylene glycol ethers and alcohol polyalkylene glycol ethers blocked by end groups, and if appropriate other dyeing assistants, which comprises (a) introducing the textile materials into aqueous dyebaths comprising, in addition to the dye, at least one surfactant and if appropriate other dyeing assistants and acids, and heating these dyebaths to the boiling point (b) dyeing the textile material briefly at this temperature, (c) cooling the baths exhausted of dyestuff to temperatures of 50° to 90° C. and (d) subsequently removing the dyed textile material from the dyebaths and finishing it.

Suitable surfactants which are used are advantageously components (I) of the general formula $$R\text{-}U\text{-}(R_1\text{-}O)_m\text{-}W \qquad (1),$$

in which R is an aliphatic radical having 4 to 24 carbon atoms,

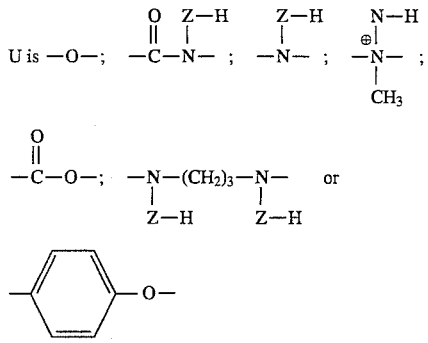

in which Z is a direct bond or $(R_1\text{-}O)_r$ and r is a number from 1 to 80, $R_1$ is alkylene having 2 to 4 carbon atoms, W is hydrogen, $C_1$-$C_4$alkyl which is unsubstituted or substituted by one or more substituents from the group comprising carboxyl, hydroxyl, isocyanato, phenyl, benzyloxymethylene and phenethyloxymethylene; carboxy or a radical —CONH—$R_2$, in which $R_2$ is alkyl having 1 to 8 carbon atoms, and in which, if U contains a quaternary nitrogen atom, W is sulfate, $CH_3SO_4^-$ or a halogen anion, preferably $Cl^-$, and m is a number from 1 to 80, and $(R_1\text{-}O)_m$ are m identical or different radicals $(R_1\text{-}O)$, or (II) of the general formula $$R\text{-}U_1\text{-}N^{\oplus}(R_{30}R_{31})\text{-}R_{32}P^{\ominus} \qquad (2),$$

in which R is an aliphatic radical having 4 to 24 carbon atoms; $U_1$ is a direct bond or a radical CO—NH—$(CH_2)_{1\text{-}3}$; $R_{30}$, $R_{31}$ and $R_{32}$ independently of one another are $C_1$-$C_4$alkyl which is unsubstituted or substituted by hydroxyl and P is COO or $SO_3$, or (III) of the general formula $$R\text{-}U_1\text{-}N(R_{30})\text{-}R_{32}\text{-}P_1 \qquad (3),$$

in which R, $U_1$, $R_{30}$ and $R_{32}$ are as defined for formula (2) and $P_1$ is COOM or $SO_3M$, in which M is hydrogen, an alkali metal or ammonium, or (IV) of the general formula

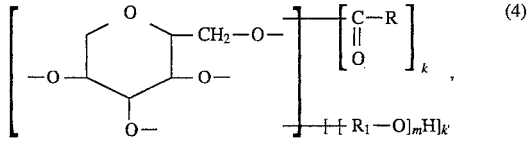

(4)

in which R is an aliphatic radical having 4 to 24 carbon atoms, $R_1$ is alkylene having 2 to 4 carbon atoms, the sum k+k'=4, in which k=1, 2 or 3, and m is a number from 1 to 80.

The invention furthermore relates to the dyeing assistants for carrying out the process, and to the textile materials dyed according to the invention.

The compounds of component ( 1 ) are, in particular, fatty alcohol polyalkylene glycol ethers of the formula $$R\text{-}O\text{-}(R_1\text{-}O)_m\text{-}H \qquad (1a),$$

in which R is an aliphatic radical having 4 to 24 carbon atoms, in particular 6 to 24 carbon atoms, $R_1$ is alkylene having 2 to 4 carbon atoms and m is a number from 1 to 80, preferably 2 to 50, and $(R_1\text{-}O)_m$ is m identical or different radicals $(R_1\text{-}O)$.

The substituent R is advantageously the hydrocarbon radical of a saturated or unsaturated aliphatic monoalcohol having 4 to 24 carbon atoms. The hydrocarbon radical can be straight-chain or branched. R is preferably alkyl or alkenyl having 8 to 22, and in particular 8 to 18 carbon atoms.

Suitable aliphatically saturated alcohols are naturally occurring alcohols, for example hexyl alcohol, octyl alcohol, lauryl alcohol, myristyl alcohol, cetyl alcohol, stearyl alcohol, arachidyl alcohol or behenyl alcohol, and synthetic alcohols, for example oxo alcohols, such as, in particular, 2-ethylbutanol, 2-methylpentanol, 5-methylheptan-3-ol, 2-ethylhexanol, 1,1,3,3-tetramethylbutanol, octan-2-ol, isononyl alcohol, trimethylhexanol, trimethylnonyl alcohol, decanol, $C_9$-$C_{11}$oxo alcohol, tridecyl alcohol, isotridecanol or linear primary alcohols (Alfols) having 8 to 18 carbon atoms. Some representatives of the Alfols are Alfol (8–10), Alfol (9–11), Alfol (10–14), Alfol (12–13) or Alfol (16–18) "Alfol" is a registered trademark).

Unsaturated aliphatic monoalcohols are, for example, dodecenyl alcohol, hexadecenyl alcohol or oleyl alcohol.

The alcohol radicals can be present individually or in the form of mixtures of two or more components, for example mixtures of alkyl and/or alkenyl groups which are derived, for example, from the corresponding fatty acids.

—$OR_1O$— is derived from 1,2- or 1,3-propylene glycol, 1,4-butylene glycol or, preferably, ethylene glycol.

m is preferably a number from 2 to 50, and particularly preferably from 4 to 20.

The compounds of the formula (1a) are known, for example, from EP-A-312 493.

The compounds of component (I) are furthermore, in particular, compounds of the formula $$R-O-(R_1-O)_{m_1}-\underset{X_1}{CH}-\underset{X_2}{CH}-OH, \quad (1b)$$

in which R is an aliphatic radical having 4 to 24 carbon atoms, in particular 6 to 24 carbon atoms, $R_1$ is alkylene having 2 to 4 carbon atoms, $X_1$ is hydrogen or phenyl, $X_2$ is hydrogen or phenyl, $X_1$ and $X_2$ differing from one another, and $m_1$ is a number from 2 to 80, preferably from 4 to 50, or compounds of the formula $$R-O-(R_1-O)_{m_1}-\underset{Y_1}{CH}-\underset{Y_2}{CH}-OH, \quad (1c)$$

in which R is an aliphatic radical having 4 to 24 carbon atoms, in particular 6 to 24 carbon atoms, $R_1$ is alkylene having 2 to 4 carbon atoms, one of the radicals $Y_1$ or $Y_2$ is benzyloxymethylene or phenethyloxymethylene and the other is hydrogen, and $m_1$ is a number from 2 to 80, preferably from 4 to 50, or compounds of the formula $$R\text{-}O\text{-}(R_1\text{-}O)_n\text{-}CONH\text{-}R_2 \quad (1d),$$

in which R is an aliphatic radical having 4 to 24 carbon atoms, in particular 6 to 24 carbon atoms, $R_1$ is alkylene having 2 to 4 carbon atoms, $R_2$ is alkyl having 1 to 8 carbon atoms, in particular 3 to 5, and n is a number from 2 to 60, preferably from 4 to 20.

The preferred meanings for R and —$OR_1O$— in the compounds of the formulae (1b) to (1d) are as defined for the compounds of the formula (1a).

The compounds of the formulae (1b) and (1c) are known from EP-A-378 048 and EP-A-406 168.

Preferred compounds of the formula (1d) are, for example, the reaction products from the addition products of, preferably, 2 to 60 tool of alkylene oxides, in particular ethylene oxide, and higher unsaturated or saturated $C_8$-$C_{18}$fatty alcohols with $C_1$-$C_8$alkyl isocyanates.

Compounds which are of special interest are those of the formula $$R_3-O-(CH_2-CH_2-O)_{n_2}-(\underset{Y_3}{CH}-\underset{Y_4}{CH}-O)_{m_2}-R_4, \quad (1e)$$

in which $R_3$ is $C_9$ to $C_4$alkyl, $R_4$ is hydrogen or a lower alkyl isocyanate radical, one of the radicals $Y_3$ or $Y_4$ is methyl and the other is hydrogen, $m_2$ is an integer from 0 to 8 and $n_2$ is an integer from 4 to 10.

Compounds which are of special interest here are those of the formula (1e) in which $R_4$ is a lower alkyl isocyanate radical and m2 is 0.

Especially preferred compounds here are those in which the lower alkyl isocyanate radical is the n-butyl isocyanate or isopropyl isocyanate radical.

The nonionic surfactants of the formula (1e) blocked by lower alkyl isocyanate end groups are prepared by reacting the alkyl polyalkylene glycol ethers with a lower alkyl isocyanate using a catalyst or catalyst mixture.

Compounds which are likewise of special interest are those of the formula $$R\text{-}O\text{-}(R_1\text{-}O)_n\text{-}W_1 \quad (1f),$$

in which R is an aliphatic radical having 4 to 24 carbon atoms, $R_1$ is alkylene having 2 to 4 carbon atoms, $W_1$ is an aliphatic radical having 1 to 6 carbon atoms, n is a number from 2 to 60, preferably from 4 to 20, and $(R_1\text{-}O)_n$ is n identical or different radicals $(R_1\text{-}O)$.

The compounds of component (I) furthermore are, in particular, compounds of the formula $$R\text{-}O\text{-}(R_1\text{-}O)_{n_1}\text{-}CH_2\text{-}COOH \quad (1g),$$

in which R is an aliphatic radical having 4 to 24 carbon atoms, $R_1$ is alkylene having 2 to 4 carbon atoms and $n_1$ is a number from 2 to 20.

Compounds of component (1) which are likewise preferred are those of the general formula $$R\text{-}COO\text{-}(R_1\text{-}O)_{n_6}\text{-}W_2 \quad (1h),$$

in which R is an aliphatic radical having 4 to 24 carbon atoms, $R_1$ is alkylene having 2 to 4 carbon atoms, $W_2$ is hydrogen or the radical OC—R and $n_6$ is a number from 6 to 30.

The preferred meanings for R and —$OR_1$—O— in the compounds of the formulae (1e) to (1h) are the same as are defined for the compounds of the formula (1a).

Compounds of component (I) which are likewise preferred are those of the general formula $$R'-\overset{\overset{O}{\|}}{C}-\overset{\overset{Z-H}{|}}{N}-(R_1-O)_{n_5}H, \quad (1i)$$

in which R' is an aliphatic radical having 8 to 24 carbon atoms, Z is a direct bond or $(R_1\text{-}O)_{r_1}$, $R_1$ is alkylene having 2 to 4 carbon atoms, $n_5$ is a number from 4 to 20 is a number from 4 to 20.

Compounds of component (I) which are likewise preferred are those of the general formula $$R'-N\begin{matrix}(R_1-O)_{m_3}H\\(R_1-O)_{n_3}H\end{matrix}, \quad (1j)$$

in which R' is an aliphatic radical having 8 to 24 carbon atoms, $R_1$ is alkylene having 2 to carbon atoms, $m_3$ is a number from 1 to 20, $n_3$ is a number from 1 to 20 and the sum of $m_3+n_3$ is 2 to 21.

Compounds of component (I) which are likewise preferred are those of the general formula $$R'\begin{matrix}\diagdown\\ \\ \diagdown\end{matrix}\overset{\oplus}{N}\begin{matrix}\diagup (R_1-O)_{m_3}H\\ \\ \diagup (R_1-O)_{n_3}H\end{matrix}\ CH_3\ X^{\ominus}, \quad (1k)$$

in which R' is an aliphatic radical having 8 to 24 carbon atoms, $R_1$ is alkylene having 2 to carbon atoms, $m_3$ is a number from 1 to 20, $n_3$ is a number from 1 to 20 and the sum $m_3+n_3$ is 2 to 21, and X is an anion from the group comprising halides, sulfates and alkylsulfates.

Compounds of component (I) which are likewise preferred are those of the general formula

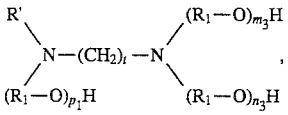

(11)

in which R' is an aliphatic radical having 8 to 24 carbon atoms, $R_1$ is alkylene having 2 to 4 carbon atoms, $m_3$ is a number from 1 to 20, $n_3$ is a number from 1 to 20, $p_1$ is a number from 1 to 20 and the sum $m_3+n_3+p_1$ is 3 to 22, and t is a number from 2 to 4.

The preferred meanings for R' and —O—$R_1$—O— in the compounds of the formula (1i) to (1l) are the same as are defined for R and —O—$R_1$—O— in formula (1a).

The dyeing process according to the invention is carded out in dyebaths comprising, if appropriate, in addition to at least one of components (I) to (IV) and the dye, other customary dyeing assistants, for example levelling agents, defoamers, other wetting agents, solvents and/or emulsifiers; and furthermore comprising inorganic salts, in particular ammonium or alkali metal salts, for example ammonium sulfate, ammonium or sodium acetate or, preferably, sodium sulfate. Preferably, 0.1 to 10% by weight of ammonium or alkali metal sulfate is used, based on the fibre material. Suitable acids which are used in the dyebaths are, for example, mineral acids, such as sulfuric or phosphoric acid, and furthermore organic acids, advantageously low molecular weight organic acids, in particular aliphatic carboxylic acids, such as formic, acetic or oxalic acid. The acids are used in particular to adjust the pH of the dyebaths, which as a rule is in the range from 4 to 6.5, a pH of about 4.2 to 4.7 being suitable for wool dyeings and a pH of 5 to 6.5, in particular 5.5 to 6.0, being suitable for dyeing polyamide fibres.

Levelling agents, for example compounds based on fatty amines, as defined in the following formulae (6) to (8), are usually additionally used in the dyebaths used according to the invention, mixtures of an anionic compound of the formula

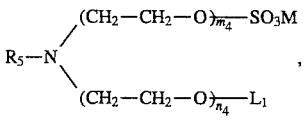

(6)

in which $R_5$ is an alkyl or alkenyl radical having 12 to 22 carbon atoms, M is hydrogen, an alkali metal or ammonium, $L_1$ is hydrogen or a radical $SO_3M$ and $m_4$ and $n_4$ are integers, the sum of $m_4$ and $n_4$ being 2 to 14, a quaternary compound of the formula

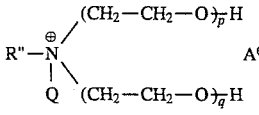

(7)

in which R'' , independently of $R_5$, is as defined for $R_5$, A is an anion, Q is a substituted or unsubstituted alkyl radical and p and q are integers, the sum of p and q being 20 to 50, and a nonionic compound of the formula

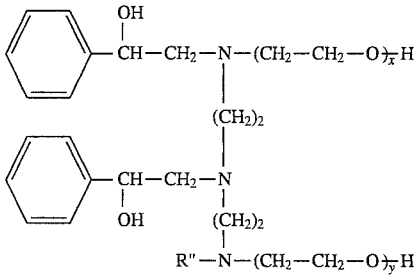

(8)

in which R'' , independently of $R_5$, is as defined for $R_5$ and x and y are integers, the sum of x and y being 80 to 140, being particularly preferred. This levelling agent mixture is known, for example, from EP-A-89 004.

The levelling agent mixture mentioned can be mixed with at least one of the components (I) to (IV), i.e. with at least one of the compounds of the formulae (1a) to (1d), and then forms a dyeing assistant which is suitable for the dyeing process according to the invention and to which the present invention also relates.

These dyeing assistants according to the invention thus preferably comprise the mixture of compounds of the formulae (6), (7) and (8) (called $M_1$ below), in combination with at least one compound, preferably two compounds, of the formulae (1a) to (1d) (called $M_2$ below).

The ratios of the amounts of the individual components in mixture $M_1$ are about 5 to 70 parts of the compound of the formula (6), 15 to 60 parts of the compound of the formula (7) and 5 to 60 parts of the compound of the formula (8), based on 100 parts of $M_1$.

If two compounds are used in $M_2$, the weight ratios are in the range from 20:80 to 80:20. $M_2$ preferably contains the compounds of the formulae (1a) and (1b), (1a) and (1c), or (1a) and (1d).

The dyeing assistant mixture of $M_1$ and $M_2$ according to the invention comprises these two components in the weight ratio of (0.1–1):1.

These mixtures are in the form of aqueous or aqueous-organic preparations, in particular solutions (suitable solvents are, for example, glycols and glycol ethers, such as butyltriglycol) having an active substance content of 25 to 70 per cent by weight.

The amounts of these aqueous or aqueous/organic preparations used are in the range from 0.3 to 3 per cent by weight, preferably 0.5 to 2 per cent by weight, based on the fibre material to be dyed.

The anionic dyes which can be used can belong to the most diverse dye classes, and can contain one or more sulfonic acid groups, if appropriate, and one or more fibre-reactive groups, if appropriate. They are, in particular, triphenylmethane dyes having at least two sulfonic acid groups, monoazo and disazo dyes which are free from heavy metals and have in each case one or more sulfonic acid groups and, if appropriate, one or more fibre-reactive groups, and monoazo, disazo, azomethine and formazan dyes which contain heavy metals, i.e. contain copper, chromium, nickel or cobalt, in particular metallised dyes which contain two molecules of azo dye or one molecule of azo dye and one molecule of azomethine dye bonded to a metal atom, in particular those which contain mono- and/or disazo dyes and/or azomethine dyes as ligands and a chromium or cobalt ion as the central metal ion, and also anthraquinone dyes, in particular 1-amino-4-arylamino-anthraquinone-2-sulfonic acids or 1,4-diarylamino- or 1-cycloalkylamino-4-arylaminoanthraquinonesulfonic acids. Fibre-reactive groups are to be understood as meaning those groups which undergo covalent bonding with the polyamide material to be dyed.

Dyes which contain one or more fibre-reactive groups are preferably used in the process according to the invention in combination with dyes which are not fibre-reactive.

The amounts in which the dyes can be used in the dyebaths can vary within wide limits, depending on the desired depth of shade, and advantageous amounts are 0.001 to 10 per cent by weight, based on the goods to be dyed, of one or more dyes.

Suitable anionic dyes are, in particular, those of the following dye classes:

(a) triphenylmethane dyes having at least two sulfonic acid groups, of the formula

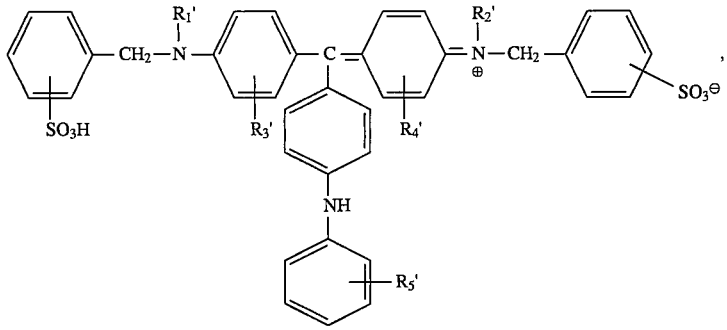

(9)

in which $R_1'$ and $R_2'$ independently of one another are $C_{1-4}$alkyl, $R_3'$ and $R_4'$ independently of one another are hydrogen or $C_{1-4}$alkyl and $R_5'$ is $C_{1-4}$alkyl, $C_{1-4}$alkoxy or hydrogen;

(b) mono- and disazo dyestuffs of the formulae

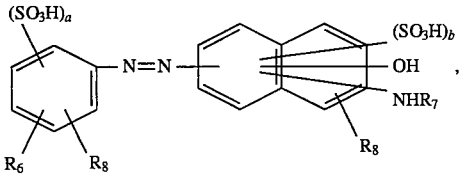

(10)

in which $R_6$ is a fibre-reactive group bonded via the —NH— group, benzoylamino, phenoxy, chlorophenoxy or methylphenoxy, $R_7$ is hydrogen, benzoyl, dichlorophenoxy, phenyl, $C_{1-4}$alkyl, phenylsulfonyl, methylphenylsulfonyl or a fibre-reactive group which is bonded, if appropriate, via aminobenzoyl, and the substituents $R_8$ independently of one another are hydrogen or a phenylamino or N-phenyl-N-methyl-amino-sulfonyl radical, a is 0 or 1 and b is 0, 1 or 2;

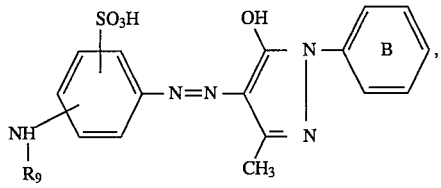

(11)

in which $R_9$ is a fibre-reactive group and the phenyl ring B can be substituted by halogen, $C_{1-4}$alkyl and sulfo;

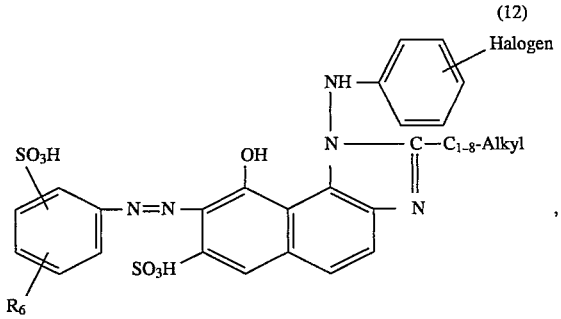

(12)

in which $R_6$ is as defined under formula (10);

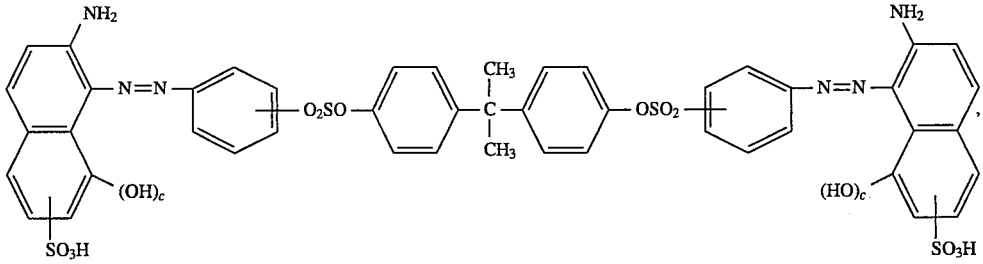

(13)

in which c is=0 or 1;

(13a)

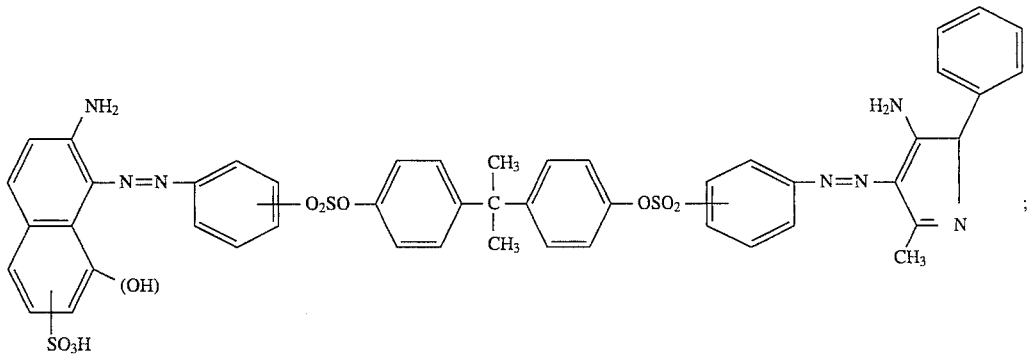

(c) 1:2 metal complex dyes, such as the 1:2 chromium complex dyes of the azo and azomethine dyes of the formula (14)

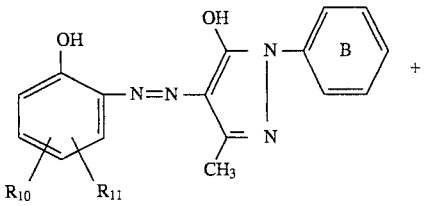

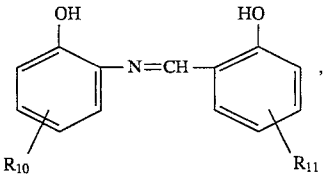

in which $R_{10}$ is hydrogen, sulfo or phenylazo and $R_{11}$ is hydrogen or nitro, and the phenyl ring B can contain the substituents defined under formula (11);

(d) 1:2 metal complex dyes, such as the symmetric 1:2 chromium complex dyes of the azo dyes of the formulae (15)

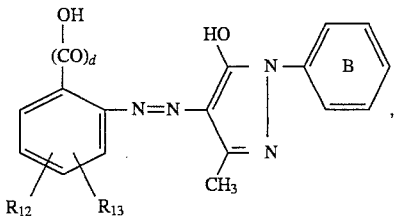

in which the phenyl ring B can contain the substituents defined under formula (11), and $R_{12}$ and $R_{13}$ independently of one another are hydrogen, nitro, sulfo, halogen, $C_{1-4}$alkylsulfonyl, $C_{1-4}$alkylaminosulfonyl and $—SO_2NH_2$ and d is 0 or 1;

(16)

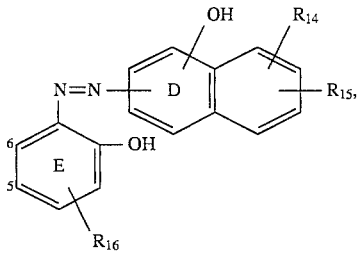

in which $R_{14}$ is hydrogen, $C_{14}$alkoxy-carbonylamino, benzoylamino, $C_{1-4}$alkylsulfonyl, phenylsulfonylamino, methylphenylsulfonylamino or halogen, $R_{15}$ is hydrogen or halogen and $R_{16}$ is $C_{1-4}$alkylsulfonyl, $C_{1-4}$alkylaminosulfonyl, phenylazo, sulfo or $—SO_2N_2$, and in which the hydroxyl group in the benzo ring D is bonded in the o-position relative to the azo bridge to the benzo ting D, and the benzo ting E can contain a nitrobenzene ring fused onto the 5- and 6-position; the symmetric 1:2 cobalt complexes of the azo dyes of the formula (17)

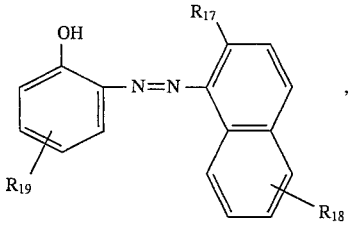

in which $R_{17}$ is the —OH or $NH_2$ group, $R_{18}$ is hydrogen or $C_{1-4}$alkylaminosulfonyl and $R_{19}$ is nitro or $C_{1-4}$alkoxy-$C_{1-4}$alkyleneaminosulfonyl;

(18)

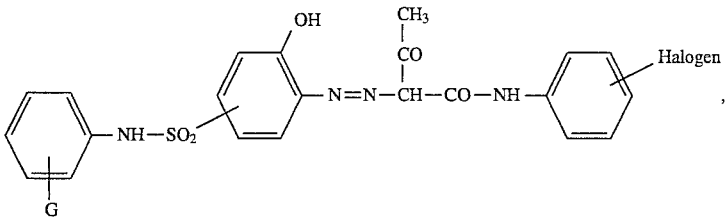

in which G is —COOH or $—SO_3H$; the unsymmetric 1:2 metal complex dyes, such as the 1:2 chromium complex dyes, of the azo dyes of the formulae (19)

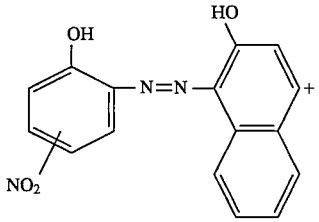

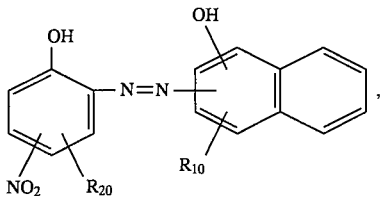

in which one substituent $R_{20}$ is hydrogen and the other is sulfo;

(20)

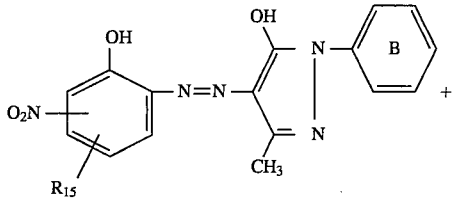

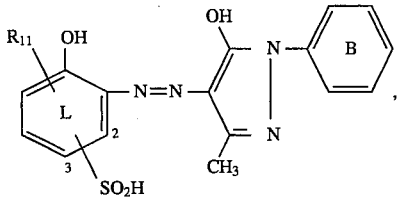

in which $R_{11}$ is as defined under formula (14) and $R_{15}$ is as defined under formula (16), and the phenyl rings B independently of one another can contain the substituents defined under formula (11), and the phenyl ring L can contain a benzene ring fused onto the 2- and 3-position or, instead of the sulfo group, a sulfobenzene ring fused onto the 2- and 3-position;

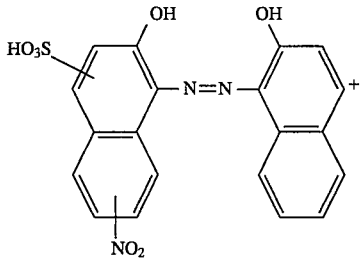

-continued (21)

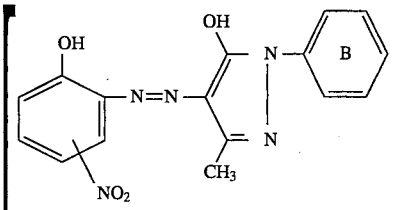

(22)

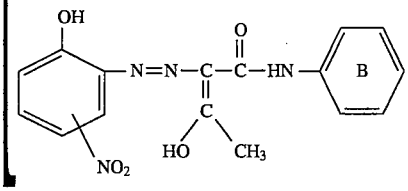

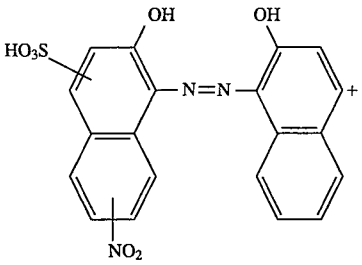

(23)

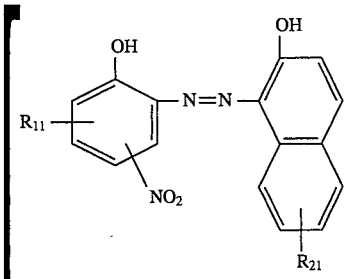

(24)

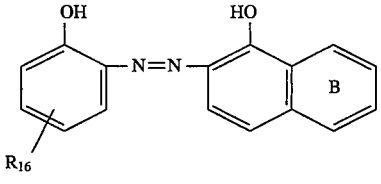

in which the phenyl ring B in formulae (21), (22) and (24) can contain the substituents defined under formula (11 ), $R_1$ is as defined under formula (19), $R_{12}$ is hydrogen, methoxycarbonylamino or acetylamino and $R_6$ is as defined under formula (16); 1:2 chromium complex dyes of the azo dyes of the formulae (15) and (16); and 1:2 chromium mixed complexes of the azo dyes of the formulae (15) and (16); and (e) anthraquinone dyes of the formulae (25)

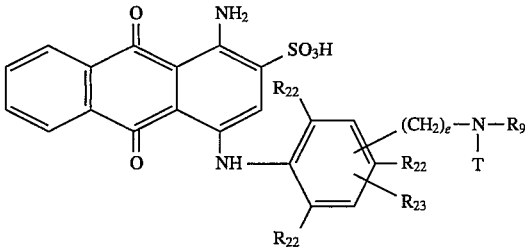

in which T is hydrogen or $C_{1-4}$alkyl, e is 0 or 1 and $R_9$ is as defined under formula (11), $R_{22}$ independently of one another are hydrogen or $C_{1-4}$alkyl and $R_{23}$ is hydrogen or sulfo;

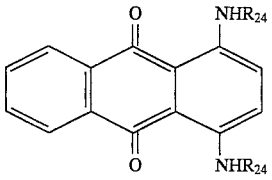

(26)

in which the substituents $R_{24}$ independently of one another are cyclohexyl and the diphenyl ether radical, which can be substituted by sulfo and the radical —$CH_2NH$—$R_9$, in which $R_9$ is as defined under formula (11); and

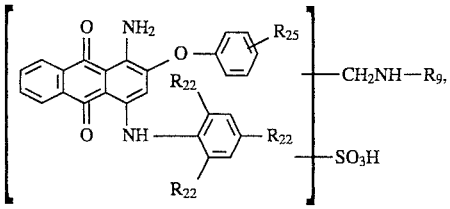

(27)

in which $R_9$ is as defined under formula (11) and $R_{22}$ is as defined under formula (25), and $R_{25}$ is $C_{4-8}$alkyl.

Suitable fibre-reactive groups in the formulae shown are, for example, those of the aliphatic series, such as acryloyl, mono-, di- or trichloro- or mono-, di- or tribromoacryloyl or —methacryloyl, such as —CO—CH=CH—Cl, —CO—CCl=$CH_2$, —CO—CH=CHBr, —COCBr=$CH_2$, —CO—CBr=CHBr or —CO—CCl=CH—$CH_3$, and furthermore —CO—CCl—CH—COOH, —CO—CH=CCl—COOH, 4-chloropropionyl, 3-phenylsulfonylpropionyl, 3-methylsulfonylpropionyl, β-sulfatoethylaminosulfonyl, vinylsulfonyl, β-chloroethylsulfonyl, β-sulfatoethylsulfonyl, β-methylsulfonylethylsulfonyl, β-phenylsulfonylethylsulfonyl, 2-fluoro-2-chloro-3,3difluorocyclobutane-1-carbonyl, 2,2,3,3,tetrafluorocyclobutane-1-carbonyl or —1-sulfonyl, β-(2,2,3,3-tetrafluorocyclobut-1-yl)-acryloyl and α- or β-alkyl- or -arylsulfonylacryloyl, such as α- or β-methylsulfonylacryloyl.

Reactive radicals which are particularly suitable for wool are: chloroacetyl, bromoacetyl, α,β-dichloro- or α, β-dibromopropionyl, α-chloro- or α-bromoacryloyl, 2,4-difluoro-5-chloropyrimid-6-yl, 2,4,6-trifluoropyrimid-5-yl, 2,4-dichloro-5-methylsulfonylpyrimidin-6-yl, 2-fluoro-4-methyl-5-chloropyrimidinyl-6,2,4-5-chloropyrimid-6-yl, 2,4-difluoro-5-methylsulphonylpyrimid-6-yl, 2,4-difluorotriazin-6-yl and fluorotriazinyl radicals of the formula

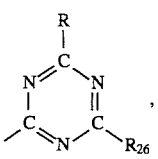

in which R26 is an optionally substituted amino group or an optionally etherified oxy or thio group, for example the $NH_2$ group, an amino group which is mono- or disubstituted by $C_1$-$C_4$alkyl radicals, a $C_1$-$C_4$alkoxy group, a $C_1$-$C_4$alkylmercapto group, arylamino, in particular phenylamino, or phenylamino which is substituted by methyl, methoxy, chlorine and in particular sulfo, phenoxy, mono- or disulfophenoxy and the like, and the corresponding chlorotriazinyl radicals.

The dyes which contain sulfo groups and are used in the process according to the invention are either in the form of their free sulfonic acid or, preferably, in the form of salts thereof.

Suitable salts are, for example, the alkali metal, alkaline earth metal or ammonium salts or the salts of an organic amine. Examples are the sodium, lithium, potassium or ammonium salts or the triethanolamine salt.

If dye mixtures are used in the process according to the invention, they can be prepared by mixing the individual dyes. This mixing process is carried out, for example, in suitable mills, for example ball and pinned disc mills, and in kneaders or mixers.

The dye mixtures can furthermore be prepared by spray drying the aqueous dye mixtures.

Dyeing is carded out from an aqueous liquor by the exhaust process at temperatures within the boiling range of the liquor, i.e. between 95° and 105° C., in particular between 98° and 103° C. The dyeing time is as a rule 5 to 25, and in particular 10 to 20 minutes.

The liquor ratio can be chosen within a wide range, for example from 1:5 to 1:40, preferably from 1:8 to 1:25.

The dyeing assistant mixture according to the invention is advantageously admixed to the aqueous dye liquor and applied at the same time as the dye. A procedure can also be followed in which the goods to be dyed are first treated with the dyeing assistant mixture and dyeing is carded out in the same bath, after addition of the dye. Preferably, the fibre material is introduced into a liquor which comprises the acid and the dyeing assistant mixture and has a temperature of 20° to 70° C., preferably 40 to 50° C. The dye or a dye mixture is then added, and the temperature of the dyebath is increased at a heating up rate of 1° to 4° C. per minute, for the dyeing to be carded out in the stated temperature range of 95° to 105° C., preferably for 10 to 20 minutes. Thereafter, the bath is cooled to 70° to 90° C. and the dyed material is rinsed and dried in the customary manner; preferably, the dyed fibre material can also be (centrifuged and) dried without being rinsed.

No special devices are necessary in the process according to the invention. The customary dyeing apparatuses and machines, for example for loose stock, slubbing, hank yarn, wound packages, woven fabric, knitted fabric, piece-goods and carpets, can be used.

Suitable polyamide fibre materials which can be dyed according to the invention are those of naturally occurring polyamides, in particular wool, and also blends of wool/polyamide, wool/polyester, wool/cellulose or wool/polyacrylonitrile, as well as silk, and of synthetic polyamides, such as polyamide 6 or 6,6. The fibre material can be in the most diverse forms of make-up, for example as loose material, slubbing, yam, woven fabric, knitted fabric and piece-goods, or as carpet.

The dyeing process according to the invention leads to naturally occurring or synthetic polyamide fibre textile materials dyed in a level manner over the fibre and surface. The main advantages of the process are the short dyeing time (which is therefore gentle on the fibre) and the complete absorption of the dye onto the fibre, i.e. the dyebath is completely extracted (exhausted) and, after appropriate adjustment, can be used for further dyeings. This adjustment relates to the required dye, dyeing assistant and salt content, as well as the pH and the volume of the dyebath.

This re-use of dye liquors (dyeing from static baths) is possible for dyeing with identical dyes or dyes which differ from dyebath to dyebath, without shifts in colour shade and loss in yield occurring in the particular subsequent dyeing.

Dyeing from static baths (re-use of already heated aqueous liquors) leads to considerable savings in time and energy.

A dyeing process as an alternative to the process according to the invention is carried out at temperatures below the boiling point and requires somewhat longer dyeing times.

This is a process for dyeing textile materials of naturally occurring or synthetic polyamide fibres in aqueous dyebaths comprising at least one of components (I) to (IV) (see above) and if appropriate other dyeing assistants, which comprises (a) introducing the textile materials into aqueous dyebaths comprising, in addition to the dye, at least one of components (I) to (IV) and if appropriate other dyeing assistants and acids, and heating these dyebaths to temperatures of 75° to 90° C., (b) dyeing the textile material at these temperatures for 30 to 90 minutes, and (c) cooling the dyebaths exhausted of dye to 50° to 70° C. and then removing the dyed textile material from the dyebaths and finishing it.

Preparation Instructions (Compounds of the Formula (1d)):

(A) 51 g (about 0.1 mol) of the addition product of 1 mol of decyl alcohol and 8 mol of ethylene oxide are dissolved in 25 ml of tetrahydrofuran and treated with 8.9 g (0.105 mol) of isopropyl isocyanate. After addition of a catalyst mixture of 100 µl each of dibutyltin laurate and triethylamine, the mixture is heated to 60° C. in a stream of inert gas, while stirring. After 90 minutes, the reaction is ended by pouring the mixture into 100 ml of petroleum ether, and the product, which precipitates in almost colourless form, is separated off. After drying at a temperature of 50° in vacuo, the slightly oily product is obtained in a yield of 56.8 g.

(B) 153 g (about 0.3 mol) of the addition product of 1 mol of decyl alcohol and 8 mol of ethylene oxide are initially introduced into the reaction vessel under an inert gas, without a solvent, and 30.9 g (0.105 mol) of n-butyl isocyanate are added dropwise, while stirring. After addition of a catalyst mixture of 100 µl each of dibutyltin laurate and triethylamine, slight warming of the reaction mixture to about 40° initially occurs. At an internal temperature of 60°, the reaction has ended completely after 60 minutes. Finally, the mixture is poured into 100 ml of petroleum ether (40–80). After the liquid product which has precipitated and been isolated has been dried in vacuo at 50°, a yield of 167 g is achieved.

The following examples serve to illustrate the invention. In these examples, parts and percentages are by weight. The temperatures are stated in degrees Celsius. Parts by weight and parts by volume bear the same relationship as that between the gram and cubic centimeter.

The dyeing assistants used in the following examples have the following compositions:

A-1: $C_9$-$C_{11}$alkyl-O-$(CH_2CH_2O)_4$-H

A-2: mixture of 35 parts of $C_9$-$C_{11}$alkyl-O-$(CH_2CH_2O)_8$-$CONH(CH_2)_3CH_3$ 10 parts of a mixture of 12.6 parts of the anionic compound of the formula

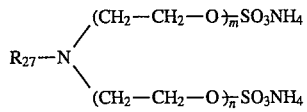

(28)

($R_{27}$=hydrocarbon radical of tallow fatty amine, m+n=8);

21.3 parts of the quaternary compound of the formula

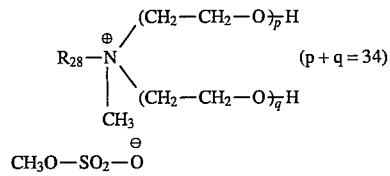

(29)

($R_{28}$=$C_{20-22}$hydrocarbon radical);

7.7 parts of the reaction product of oleyl alcohol with 80 mol of ethylene oxide;

7.0 parts of the compound of the formula

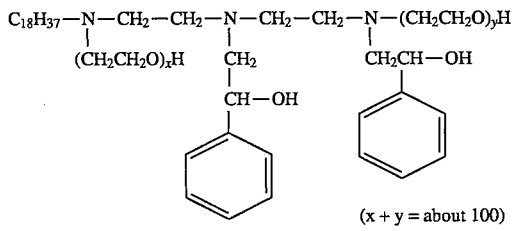

(30)

and 51.4 parts of water, 20 parts of butyltriglycol 35 parts of water

A-3: $C_{10}$alkyl−O−$(CH_2CH_2O)_8$−$CONHCH(CH_3)_2$

A-4: $C_{10}$alkyl−O−$(CH_2CH_2O)_8$−$CONH(CH_2)_3CH_3$

A-5: 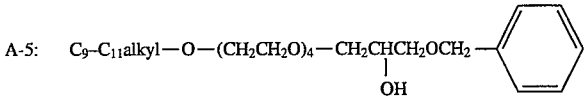

A-6: 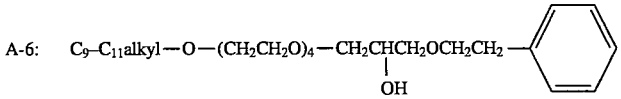

A-7: $C_{12}$–$C_{14}$alkyl−O−$(CH_2CH_2O)_{2,5}CH_2$−COOH

A-8: $C_{16}$–$C_{18}$alkyl−O−$(CH_2CH_2O)_9CH_2$−COOH

-continued

A-9: $H_{35}C_{17}-C(=O)-O-(CH_2CH_2-O)_9H$

A-10: $H_{35}C_{17}-C(=O)-O-(CH_2CH_2-O)_{13}-C(=O)-C_{17}H_{35}$

A-11: $H_{25}C_{12}-C(=O)-HN-(CH_2CH_2-O)_4H$

A-12: $H_{33}C_{17}-C(=O)-N(-(CH_2CH_2-O)_{15-m})-(CH_2CH_2-O)_mH$ (m = 1 to 14)

A-13: $R_{34}-CONH-(CH_2)_3-N^+(CH_3)_2-CH_2-COO^-$
($R_{34}$ = hydrocarbon radical of coconut fatty amine)

A-14: $R_{34}-CONH-(CH_2)_3-N^+(CH_3)_2-CH_2CHOHCH_2-SO_3^-$
($R_{34}$ = hydrocarbon radical of coconut fatty amine)

A-15: $R_{27}-N^+(CH_2CH_2OH)_2-CH_2-COO^-$
($R_{27}$ = hydrocarbon radical of tallow fatty amine)

A-16: $R_{34}-N^+(CH_3)(CH_2CH_2O)_fH(CH_2CH_2O)_gH/Cl^-$
($R_{34}$ = hydrocarbon radical of coconut fatty amine), f + g = 15)

A-17: $R_{34}-N(CH_2CH_2OH)_2$
($R_{34}$= hydrocarbon radical of coconut fatty amine)

A-18: $R_{27}-N(CH_2CH_2OH)-CH_2CH_2CH_2-N(CH_2CH_2OH)_2$
($R_{27}$ = hydrocarbon radical of tallow fatty amine)

A-19:
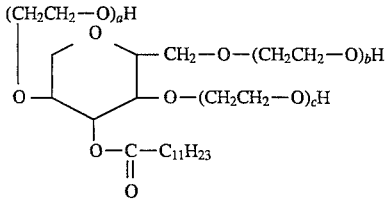

(a + b + c = 4)

A-20:
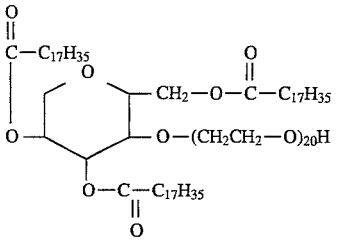

A-21: $R_{34}-C(=O)-NH-CH_2CH_2-N(CH_2CH_2OH)-CH_2COOH$
($R_{34}$ = hydrocarbon radical of coconut fatty amine)

A-22: $C_9$–$C_{11}$alkyl $-O-(CH_2CH_2O)_4-(CH(CH_3)CH_2O)_2-H$

-continued

A-23: 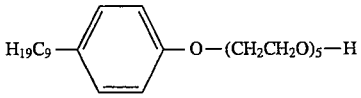

A-24: mixture of 34 parts of $C_9$-$C_{11}$alkyl-O-$(CH_2CH_2O)_4$-H and $C_9$-$C_{11}$alkyl-O-$(CH_2CH_2O)_4$-H reacted with styrene oxide (weight ratio: 2:1 )

10 parts of a mixture of 12.6 parts of the anionic compound of the formula

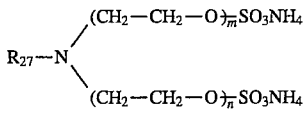

(28)

($R_{27}$=hydrocarbon radical of tallow fatty amine, m+n=8);

21.3 parts of the quaternary compound of the formula

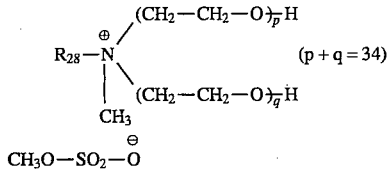

(29)

($R_{28}$=$C_{20-22}$hydrocarbon radical);

7.7 parts of the reaction product of oleyl alcohol with 80 mol of ethylene oxide;

7.0 parts of the compound of the formula

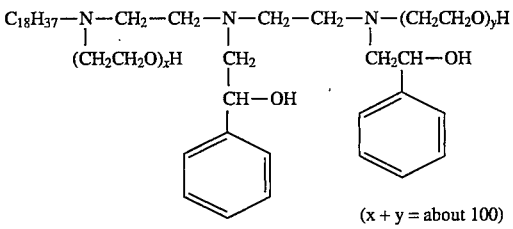

(30)

and 51.4 parts of water, 20 parts of butyltriglycol 36 parts of water

A-25: mixture of

-35 parts of

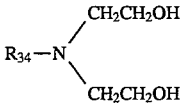

($R_{34}$=hydrocarbon radical of coconut fatty amine)

-10 parts of

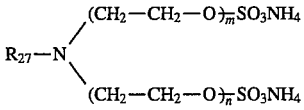

(28)

($R_{27}$=hydrocarbon radical of tallow fatty amine, m+n=8);

5 parts of the compound of the formula

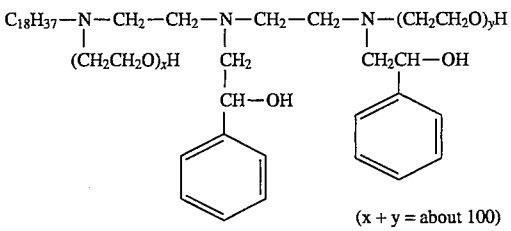

(30)

3 parts of $C_{18}H_{35}$-O-$(CH_2CH_2O)_{80}$-H 25 parts of butyltriglycol 22 parts of water A-26: mixture of 34 parts of $C_{13}$alkyl-O$(CH_2CH_2O)_5$H 10 parts of a mixture of 12.6 parts of the anionic compound of the formula

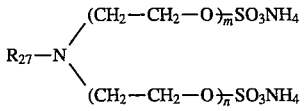

(28)

($R_{27}$=hydrocarbon radical of tallow fatty amine, m+n=8);

21.3 parts of the quaternary compound of the formula

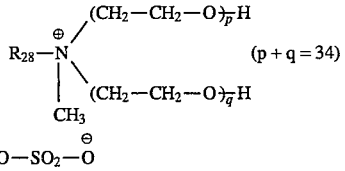

(29)

($R_{28}$=$C_{20-22}$hydrocarbon radical);

7.7 parts of the reaction product of oleyl alcohol with 80 mol of ethylene oxide;

7.0 parts of the compound of the formula

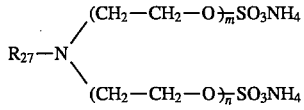

(28)

and 51.4 parts of water, 20 parts of butyltriglycol 36 parts of water

EXAMPLE 1

15 g of woollen serge are prewetted in a laboratory dyeing apparatus at 40° C. for 10 minutes with the following liquor:

0.1 g of a wetting agent (alkylphenyl ethoxylate)

75 mg of dyeing assistant A-1

0.1 g of formic acid (85%)

165 ml of water

After this initial running time, the pH of the liquor is checked and if appropriate adjusted to a value of 4.5 by addition of further formic acid. A mixture of 184 mg of the 1:2 chromium complex of the azo dyes of the formulae (101)

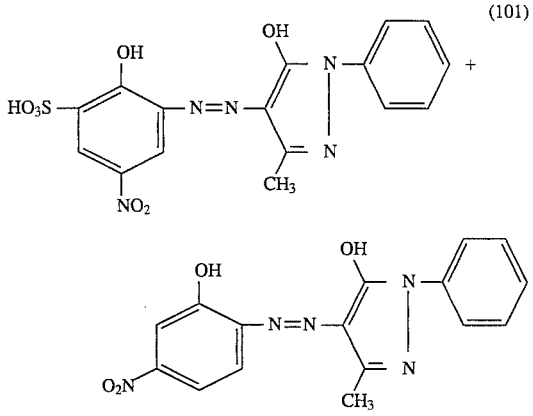

and 41 mg of the 1:2 chromium complex of the azo dye of the formula (102)

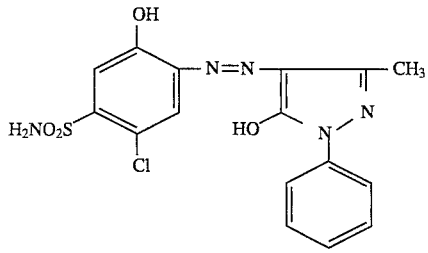

which is dissolved in 10 ml of water, is then added to the liquor. After a further 5 minutes at 40° C., the liquor is heated up to the boiling point at a rate of 1 ° C./minute, and dyeing is carded out at this temperature for 10 minutes. The liquor is then extracted to a practically water-clear state. After the liquor has been cooled to 70° C., the dyed woollen material is removed from the dyeing apparatus and then finished in the customary manner, for example by rinsing and drying. Because of the good extraction of the bath, the rinsing process can be shortened considerably.

A level red dyeing having good fastness properties and a very good depth of shade is obtained.

Instead of dyeing assistant A-1, the same amount of dyeing assistants A-7 to A-23 can also be employed.

EXAMPLE 2

40 kg of woollen slubbing are prewetted in a slubbing dyeing apparatus at 50° C. for 10 minutes with the following liquor:

120 g of a wetting agent (alkylphenyl ethoxylate)

600 g of dyeing assistant A-2

400 g of formic acid (85%)

500 l of water

Some of the liquor is then pumped into a starting tank, into which 209 g of the 1:2 cobalt complex of the dye of the formula (103)

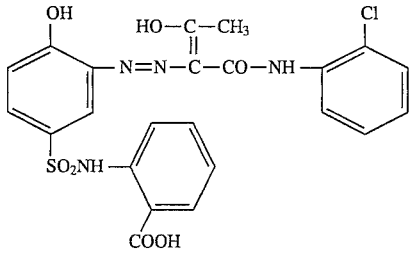

and 630 g of 1:2 chromium complex of the dye of the formula (104)

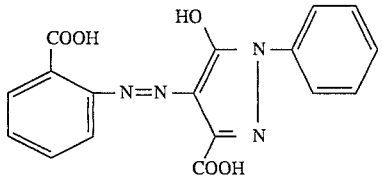

are then stirred.

When the dyes have dissolved completely, the two portions of liquor are combined. The pH of the liquor is 4.2. The liquor is then heated up to 98° C. at a rate of 2° C./minute; the woollen slubbing is dyed at this temperature for 10 minutes. After the liquor has been cooled to 80° C., the dyed goods are removed from the dyeing apparatus and allowed to drip for 5 minutes. The slubbing is then centrifuged and dried directly, without being rinsed. The dyeing is dyed a level yellow colour. The liquor is exhausted completely and its pH is 4.7.

The exhausted liquor can be used for dyeing further batches of woollen slubbing. For this, the water loss is compensated by addition of cold water. After cooling to 50° C., new goods to be dyed are introduced, the pH of the liquor is adjusted to 4.2 with formic acid and the necessary dyeing assistants and dyes are added. The second dyeing is then carded out in the same way as the first.

Further dyeings can be carded out in the same manner.

EXAMPLE 3

180 kg of woollen slubbing are pretreated in a circulatory dyeing apparatus at 50° C. for 10 minutes with the following liquor:

480 g of a wetting agent (alkylphenyl ethoxylate)

2700 g of dyeing assistant A-2

2700 g of formic acid (85%)

1.600 l of water

The pH of the liquor is 4.5.

After addition of 150 l of a dye solution which comprises 800 g of the 1:2 cobalt complex of the dye of the formula (103)

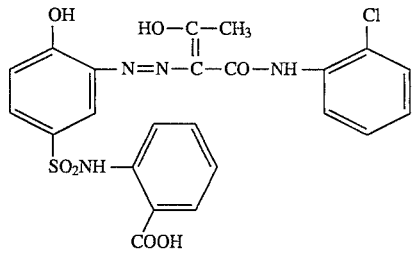

1.720 g of the 1:2 chromium complex of the dye of the formula

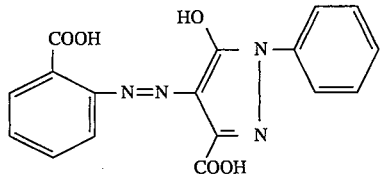

(104)

1800 g of the 1:2 chromium complex of the dyes of the formulae

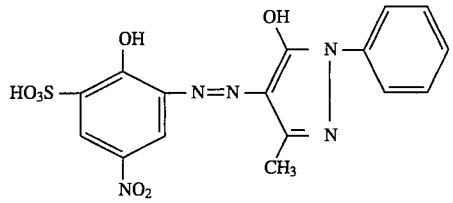

(105)

and

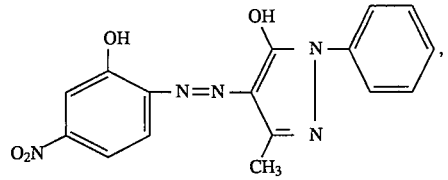

(106)

and 900 g of the dye of the formula

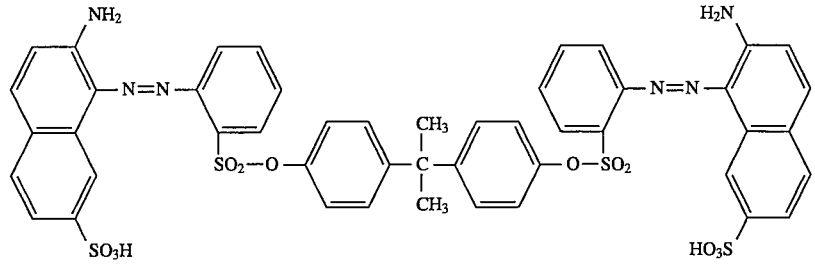

(107)

the dye liquor is kept at 50° C. for a further 5 minutes and then heated up to 95° C. with a heating up rate of 1.5° C./minute. The woollen slubbing is dyed at this temperature for 10 minutes. After the liquor has been cooled, the woollen slubbing is centrifuged and dried, without being rinsed.

An orange-coloured dyeing which is level over the fibre and surface and has good general fastness properties is obtained. The extraction of the bath is considerably better, compared with comparable dyeing with the customary dyeing assistants for 45 minutes.

Dyeings of a comparable quality are also obtained if 4500 g of acetic acid (80%) are used instead of the formic acid.

Instead of dyeing assistant A-2, dyeing assistants A-3 to A-6 and A-24 to A-26 can also be employed.

EXAMPLE 4

40 g of woollen woven fabric are prewetted in a circulatory dyeing apparatus by the beam-dyeing method at 50° C. for 10 minutes with the following liquor:

0.18 g of a wetting agent (alkylphenyl ethoxylate)

0.6 g of dyeing assistant A-2

0.6 g of formic acid (85%)

600 ml of water

The pH of the liquor is 4.5.

After addition of 50 ml of a solution comprising 0.5 g of dye mixture of the 1:2 chromium complex dyes according to Example 2, the dye liquor is kept at 50° C. for about a further 5 minutes. The liquor is then heated up to 98° C. with a heating up rate of 1 ° C./minute and the woollen woven fabric is dyed at this temperature for 10 minutes. The liquor is then cooled to 70° C.; the material, which has been dyed a level yellow colour, is removed from the liquor and dried, without being rinsed.

The abovementioned amounts of wetting and levelling agents are then added to the exhausted liquor, and 40 g of woollen woven fabric are again introduced into the liquor;, after topping up to 600 ml with water and after cooling to 50° C., the pH of the liquor is 4.5.

After addition of 50 ml of an aqueous solution which comprises 0.56 g of a mixture of the 1:2 chromium complex dyes of the formulae

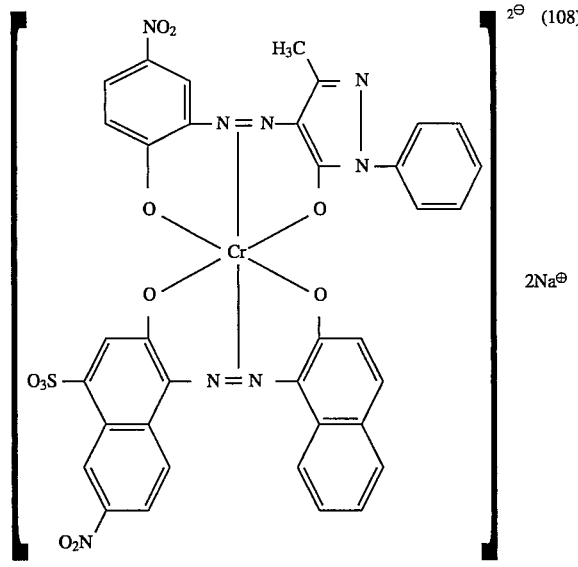

(108)

and

-continued

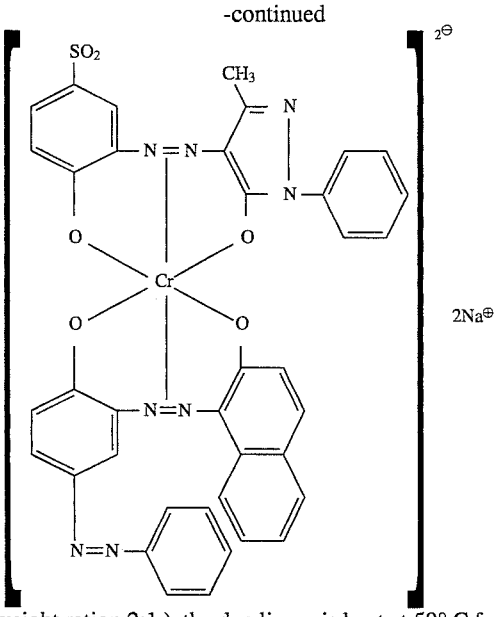

(109)

(weight ration 2:1 ), the dye liquor is kept at 50° C for about a further 5 minutes. It is then heated up to 98° C. with a heating up rate of 1° C./minute and dyeing is carded out at this temperature for 10 minutes. Further treatment is carded out as described above. A woollen woven fabric which has been dyed a level brown colour is obtained.

Further dyeings, in each case starting from an extracted bath, as described, are carried out with a dyebath comprising 0.68 g of the 1:2 chromium complex dye of the formula

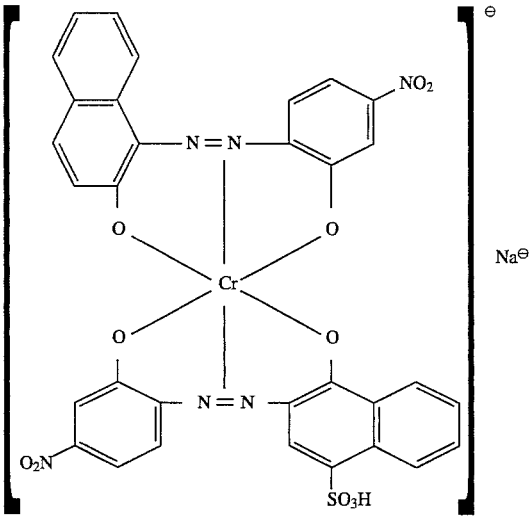

(110)

and then again with a dyebath comprising 0.56 g of the dye mixture of the dyes of the formulae (108) and (109). Navy blue and, respectively, brown dyeings are obtained.

The fifth dyeing in the same bath is then again carried out with 0.5 g of the dye mixture of the 1:2 chromium complex dyes according to Example 2.

In all cases, dyeings which are level over the fibre and surface and have good fastness properties are obtained. Comparable dyeings with conventional dyeing assistants cannot be carried out, since the exhaustion of the bath is not complete.

The exhaustion of the bath in the abovementioned dyeings leads to water-clear baths; it is thus possible to carry out dyeings from in each case the same (exhausted) bath not only with the same dye but also with dyes having different colour shades. Deviations in the colour of the dyed material compared with corresponding dyeings from in each case new dyebaths are not found.

EXAMPLE 5

10 g of woollen woven fabric are pretreated in a beaker-type dyeing apparatus at 50° C. for 10 minutes with the following liquor:

0.1 g of sodium acetate 0.5 g of sodium sulfate (anhydrous)

0.25 g of acetic acid (80%)

0.15 g of dyeing assistant A-1

100 ml of water

The pH of the liquor is 4.5.

After addition of 30 ml of a solution which comprises 0.05 g of the dye mixture according to Example 2 and 0.3 g of the dye mixture according to Example 1, the liquor is kept at 50° C. for a further 10 minutes and then heated up to 90° C. with a heating up rate of 1° C./minute. The woven fabric is then dyed at this temperature for 45 minutes. After the liquor has been cooled to 70° C., the dyed woollen woven fabric is removed from the liquor and finished by rinsing, centrifugation and drying.

A red dyeing which is level over the fibre and surface and can be achieved with customary dyeing assistants only after a dyeing time of at least 45 minutes and at a dyeing temperature of 98° C. is obtained. The degree of exhaustion of the liquor in the above dyeing at 90° C. furthermore is significantly better than in the dyeing at 98° C. mentioned.

Excellent dyeings are likewise obtained if a liquor which comprises, instead of the acetic acid, 0.15 g of formic acid and 1.5% of levelling agent A-2 is used. The pH of this liquor is also 4.5.

If, instead of dyeing assistants A-1 and A-2 in Examples 1 to 5, equivalent amounts of dyeing assistants A-3 to A-26 are: used, excellent dyeings are likewise obtained.

What is claimed is:

1. A process for dyeing a textile material composed of naturally occurring or synthetic polyamide fibres, which process comprises (a) introducing the textile material into an aqueous dyebath, which dyebath comprises an anionic dye, a surfactant and optionally other dyeing assistants and acids, (b) heating the dyebath to the boiling point, (c) dyeing the textile material for 10 to 20 minutes at the boiling point, (d) cooling the exhausted dyebath to from 50° to 90° C, and (e) subsequently removing the dyed textile material from the dyebath; wherein the surfactant comprises at least one compound selected from the group consisting of component (I) and component (III); wherein component (I) is a compound of the formula $$R-O-(R_1-O)_{m_1}-\underset{X_1}{\underset{|}{CH}}-\underset{X_2}{\underset{|}{CH}}-OH, \quad (1b)$$

in which R is an aliphatic radical having 4 to 24 carbon atoms, $R_1$ is alkylene having 2 to 4 carbon atoms, $X_1$ is hydrogen or phenyl, $X_2$ is hydrogen or phenyl, $X_1$ and $X_2$ differing from one another, and $m_1$ is a number from 2 to 80, or $$R-O-(R_1-O)_{m_1}-\underset{Y_1}{CH}-\underset{Y_2}{CH}-OH, \quad (1c)$$

in which R is an aliphatic radical having 4 to 24 carbon atoms, $R_1$ is alkylene having 2 to 4 carbon atoms, one of the radicals $Y_1$ or $Y_2$ is benzyloxymethylene or phenethyloxymethylene and the other is hydrogen, and $m_1$ is a number from 2 to 80, or $$R\text{-}O\text{-}(R_1\text{-}O)_n\text{-}CONH\text{-}R_2 \quad (1d),$$

in which R is an aliphatic radical having 6 to 24 carbon atoms, $R_1$ is alkylene having 2 to 4 carbon atoms, $R_2$ is alkyl having 3 to 5 carbon atoms, and n is a number from 4 to 20, and $(R_1\text{-}O)_n$ is n identical or different radicals $(R_1\text{-}O)$, or $$R\text{-}O\text{-}(R_1\text{-}O)_n\text{-}W_1 \quad (1f),$$

in which R is an aliphatic radical having 4 to 24 carbon atoms, $R_1$ is alkylene having 2 to 4 carbon atoms, $W_1$ is $C_1$-$C_4$alkyl and n is a number from 2 to 60, or $$R\text{-}O\text{-}(R_1\text{-}O)_{n_1}\text{-}CH_2\text{-}COOH \quad (1g),$$

in which R is an aliphatic radical having 4 to 24 carbon atoms, R1 is alkylene having 2 to 4 carbon atoms and $n_1$ is a number from 2 to 20, or $$R'-\overset{O}{\overset{\|}{C}}-\overset{Z-H}{\overset{|}{N}}-(R_1-O)_{n_5}H, \quad (1i)$$

in which R' is an aliphatic radical having 8 to 24 carbon atoms, Z is a direct bond or $(R_1\text{-}O)_{r_1}$, $R_1$ is alkylene having 2 to 4 carbon atoms, $n_5$ is a number from 4 to 20 and $r_1$ is a number from 4 to 20, or $$R'-N\begin{matrix}(R_1-O)_{m_3}H\\(R_1-O)_{n_3}H\end{matrix}, \quad (1j)$$

in which R' is an aliphatic radical having 8 to 24 carbon atoms, $R_1$ is alkylene having 2 to 4 carbon atoms, $m_3$ is a number from 1 to 20, $n_3$ is a number from 1 to 20 and the sum $m_3+n_3$ is 2 to 21, or $$\begin{matrix}R'\\(R_1-O)_{p_1}H\end{matrix}\!\!>N-(CH_2)_t-N<\!\!\begin{matrix}(R_1-O)_{m_3}H\\(R_1-O)_{n_3}H\end{matrix}, \quad (1l)$$

in which R' is an aliphatic radical having 8 to 24 carbon atoms, $R_1$ is alkylene having 2 to 4 carbon atoms, $m_3$ is a number from 1 to 20, $n_3$ is a number from 1 to 20, $p_1$ is a number from 1 to 20 sum $m_3+n_3+p_1$ is 3 to 22, and t is a number from 2 to 4, or

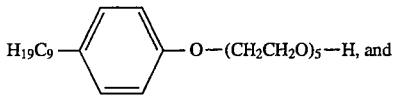

component (HI) is a compound of the formula $$R\text{-}U_1\text{-}N\ (R_{30})\text{-}R_{32}\text{-}P_1 \quad (3),$$

in which R is an aliphatic radical having 4 to 24 carbon atoms; $U_1$ is a direct bond or a radical $CO—NH—(CH_2)_{1\text{-}3}$; $R_{30}$ and $R_{32}$ independently of one another are $C_1$-$C_4$alkyl which is unsubstituted or substituted by hydroxyl and $P_1$ is COOM or $SO_3M$, in which M is hydrogen, an alkali metal or ammonium.

2. A process according to claim 1, wherein component (I) is a compound of the formula

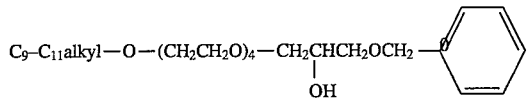

or a compound of the formula

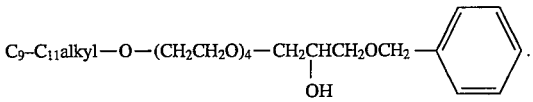

3. A process according to claim 1, wherein component (I) is a compound of the formula $$C_{10}\text{-alkyl-O-}(CH_2CH_2O)_8\text{-CONHCH}(CH_3)_2$$

or a compound of the formula $$C_{10}\text{alkyl-O-}(CH_2CH_2O)_8\text{-CONH}(CH_2)_3CH_3.$$

4. A process according to claim 1, wherein component (I) is a compound of the formula $$C_9\text{-}C_{11}\text{alkyl-O-}(CH_2CH_2O)_4[CH(CH_3)CH_2O]_2\text{-H}.$$

5. A process according to claim 1, wherein component (I) is a compound of the formula $$C_{12}\text{-}C_{14}\text{alkyl—O—}(CH_2CH_2O)_{2.5}CH_2\text{-COOH}$$

or a compound of the formula $$C_{16}\text{-}C_{18}\text{alkyl-O-}(CH_2CH_2O)_9CH_2\text{-COOH}.$$

6. A process according to claim 1, wherein component (I) is a compound of the formula

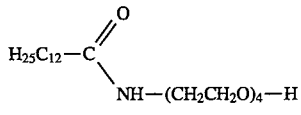

or a compound of the formula

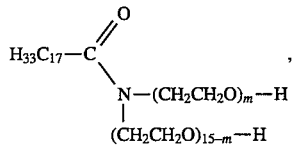

wherein m is 1 to 14.

7. A process according to claim 1, wherein component (I) is a compound of the formula

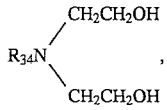

wherein $R_{34}$ is the hydrocarbon radical of coconut fatty amine.

8. A process according to claim 1, wherein component (I) is a compound of the formula

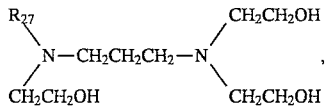

wherein $R_{27}$ is the hydrocarbon radical of tallow fatty amine.

9. A process according to claim 1, wherein component (III) is a compound of the formula

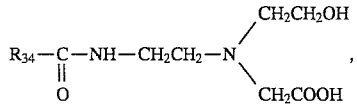

wherein $R_{34}$ is the hydrocarbon radical of coconut fatty amine.

10. A process according to claim 1, wherein the aqueous dyebath additionally comprises one or more dyeing assistants.

11. A process according to claim 10, wherein the dyeing assistant is a levelling agent, a defoamer, a wetting agent, a solvent, an emulsifier or an inorganic salt.

12. A process according to claim 11, wherein the dyeing assistant is a leveling agent which is a mixture of compounds of the formulae

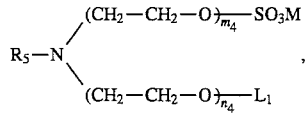

(6)

in which $R_5$ is an alkyl or alkenyl radical having 12 to 22 carbon atoms, M is hydrogen, an alkali metal or ammonium, $L_1$ is hydrogen or a radical $SO_3M$ and $m_4$ $n_4$ are integers, the sum of $m_4$ and $n_4$ being 2 to 14, and

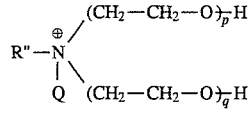

(7)

in which R", independently of $R_5$, is as defined for $R_5$, A is an anion, Q is a substituted or unsubstituted alkyl radical and p and q are integers, the sum of p and q being 20 to 50, and

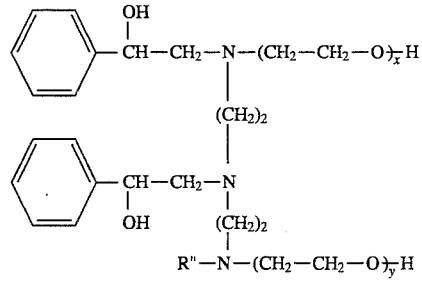

(8)

in which R" , independently of $R_5$, is as defined for $R_5$, and x and y are integers, the sum of x and y being 80 to 140.

13. A process according to claim 1 wherein the aqueous dyebath comprises a mixture of 35 parts of $C_9$-$C_{11}$alkyl-O-$(CH_2CH_2O)_8$-$CONH(CH_2)_3CH_3$ 10 parts of a mixture of 12.6 parts of the anionic compound of the formula

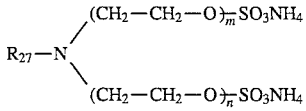

(28)

wherein $R_{27}$ is a hydrocarbon radical of tallow fatty mine and the sum of m+n is 8, 21.3 parts of a quaternary compound of the formula

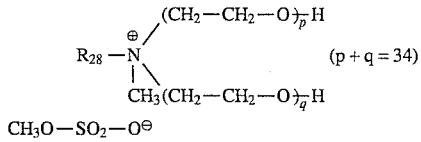

(29)

wherein $R_{28}$ is a $C_{20-22}$hydrocarbon radical, 7.7 parts of the reaction product of oleyl alcohol with 80 mol of ethylene oxide, 7.0 parts of a compound of the formula

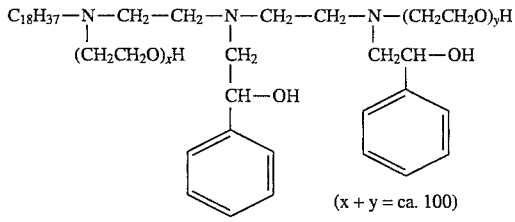

(x + y = ca. 100)

(30) and 51.4 parts of water;

20 parts of butyltriglycol, and 35 parts of water;

or a mixture of 34 parts of $C_9$-$C_{11}$alkyl-O-$(CH_2CH_2O)_4$-H and $C_9$-$C_{11}$alkyl-O-$(CH_2CH_2)_4$-H reacted with styrene oxide at a weight ratio of 2:1, 10 parts of a mixture of 12.6 parts of the anionic compound of the formula

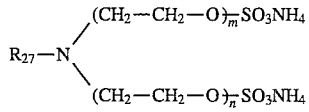

(28)

wherein $R_{27}$ is a hydrocarbon radical; of tallow fatty mine and the sum of m+n is 8; with 21.3 parts of the quaternary compound of the formula

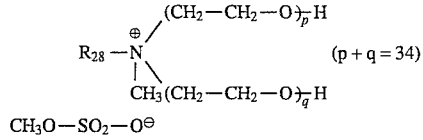

(29)

wherein $R_{28}$ is a $C_{20-22}$hydrocarbon radical, 7.7 parts of the reaction product of oleyl alcohol with 80 mol of ethylene oxide, 7.0 parts of a compound of the formula

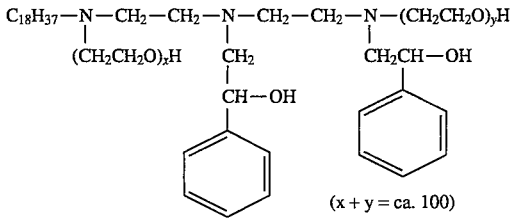

(x + y = ca. 100)

(30) and 51,4 parts of water, 20 parts of butyltriglycol and 36 parts of water;

or a mixture of

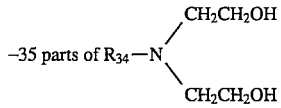

wherein $R_{34}$ is a hydrocarbon radical of coconut fatty amine

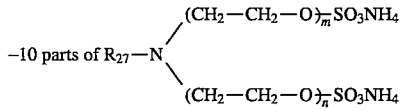

(28)

wherein $R_{27}$ is a hydrocarbon radical of tallow fatty mine and m+n is 8;

5 parts of a compound of the formula

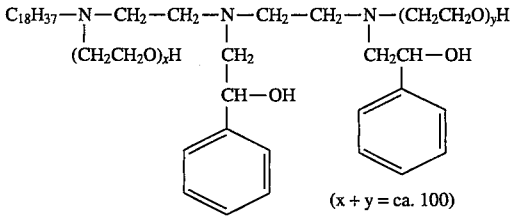

(30)

(x + y = ca. 100)

3 parts of $C_{18}H_{35}$-O-$(CH_2CH_{20})_{80}$-H 25 parts of butyltriglycol and 22 parts of water;

or a mixture of 34 parts of $C_{13}$alkyl-O$(CH_2CH_2O)_5$H 10 parts of a mixture of 12.6 parts of the anionic compound of the formula

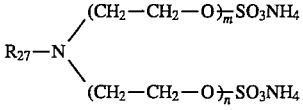

(28)

wherein $R_{27}$ is a hydrocarbon radical of tallow fatty amine and the sum of m+n is 8; 21.3 parts of the quaternary compound of the formula

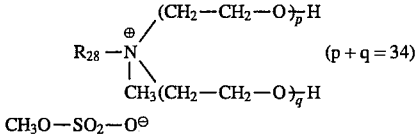

(29)

(p + q = 34)

wherein $R_{28}$ is a $C_{20-22}$hydrocarbon radical, 7.7 parts of the reaction product of oleyl alcohol with 80 mol of ethylene oxide, 7.0 parts of a compound of the formula

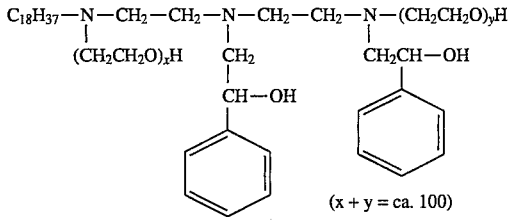

(x + y = ca. 100)

(30) and 51,4 parts of water, 20 parts of butyltriglycol and 36 parts of water.

36 parts of water.

14. A process according to claim 1, wherein the exhausted dyebaths are adjusted and reused for another dyeing.

15. A process according to claim 14, wherein the exhausted dyebaths are adjusted to the required dye, dyeing assistant and salt content, and the pH and the volume are adjusted.

16. An aqueous dyeing assistant which comprises a mixture of compounds of the formulae

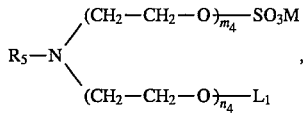

(6)

in which $R_5$ is an alkyl or alkenyl radical having 12 to 22 carbon atoms, M is hydrogen, an alkali metal or ammonium, $L_1$ is hydrogen or a radical $SO_3M$ and $m_4$ $n_4$ are integers, the sum of $m_4$ and $n_4$ being 2 to 14,

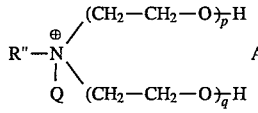

(7)

in which R", independently of $R_5$, is as defined for $R_5$, A is an anion, Q is a substituted or unsubstituted alkyl radical and p and q are integers, the sum of p and q being 20 to 50, and

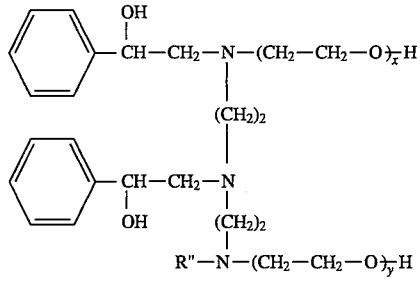

(8)

in which R", independently of $R_5$, is as defined for $R_5$, and x and y are integers, the sum of x and y being 80 to 140, and at least one compound of the formulae

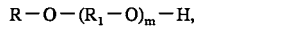

(1a)

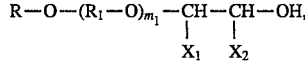

(1b)

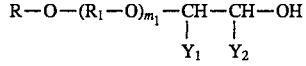

(1c)

or

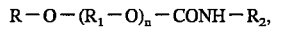

(1d)

in which R is an aliphatic radical having 4 to 24 carbon atoms, $R_1$ is alkylene having 2 to 4 carbon atoms, $R_2$ is alkyl having 1 to 8 carbon atoms, m is a number from 2 to 50, $(R_1\text{-}O)_m$ is m identical or different radicals $(R_1\text{-}O)$, $X_1$ is hydrogen or phenyl, $X_2$ is hydrogen or phenyl, $X_1$ and $X_2$ differing from one another, one of the radicals $Y_1$ and $Y_2$ is benzyloxymethylene or phenethyloxymethylene and the other is hydrogen and $m_1$ is a number from 2 to 80.

* * * * *